United States Patent [19]

Rabin

[11] 4,362,918

[45] Dec. 7, 1982

[54] RADIATION ABSORBING APPARATUS

[76] Inventor: Simon Rabin, 1140 NE. 178th Ter., North Miami Beach, Fla. 33162

[21] Appl. No.: 202,338

[22] Filed: Oct. 30, 1980

[51] Int. Cl.[3] ..... H05B 6/54

[52] U.S. Cl. ..... 219/10.81; 219/10.67; 219/10.75; 174/35 R; 361/424; 333/12

[58] Field of Search ..... 219/10.81, 10.75, 10.67, 219/10.55 D, 10.55 A; 174/35 R, 35 MS; 361/424; 333/12, 81 R; 156/273, 274, 380

[56] References Cited

U.S. PATENT DOCUMENTS

| | | | |
|---|---|---|---|
| 2,604,665 | 7/1952 | Bosomworth et al. | 219/10.81 X |
| 2,816,034 | 12/1957 | Mittelmann | 219/10.81 X |
| 2,835,874 | 5/1958 | First et al. | 174/35 R X |
| 3,329,796 | 7/1967 | Manwaring | 219/10.55 |
| 3,461,263 | 8/1969 | Manwaring | 219/10.81 |
| 3,532,848 | 10/1970 | Loring, Jr. et al. | 219/10.61 |
| 3,721,920 | 3/1973 | Mann | 219/10.81 X |
| 3,742,180 | 6/1973 | Bradley | 219/10.81 |
| 3,980,855 | 9/1976 | Boudouris et al. | 219/10.55 A |
| 4,007,350 | 2/1977 | Gillet | 219/10.81 |
| 4,028,518 | 6/1977 | Boudouris et al. | 219/10.81 |

*Primary Examiner*—Elliot A. Goldberg
*Assistant Examiner*—Philip H. Leung
*Attorney, Agent, or Firm*—Robert J. Van Der Wall

[57] ABSTRACT

Apparatus serving to significantly reduce the amount of unwanted radiation leakage of radio frequency energy normally present at high levels ambient to radio frequency dielectric heating equipment used extensively in connection with the manufacture of thermo-plastic materials, featuring elements which, when added to conventional commercially manufactured radio frequency dielectric heating equipment, combines to absorb, depress and reflect unwanted radiation leakage, resulting in energy savings, improved product quality, and reduced ambient health hazards.

22 Claims, 3 Drawing Figures

RADIATION ABSORBING APPARATUS

BACKGROUND OF THE INVENTION

This invention relates to the field of radio frequency (RF) heating presses, and, more particularly to high frequency energy absorbing apparatus to be used in connection with RF heating presses.

Prior to the present invention various methods of screening and enclosing high frequency equipment that have been in use. Screened enclosures have been frequently used. Such enclosures are costly and interfere with the flow of materials used in production.

Metallic enclosures that open and close with the application of the radio frequency power and which, in the closed position, completely surround and shield the high frequency radiating components have been proposed. Such enclosures interfere with the flow of material or continuously flowing stock, add great expense and complexity to the machines and have been found not to be very effective in terms of suppressing unwanted radiation.

There are several reasons for suppressing unwanted high frequency radiation, including but not limited to: (1) the radiated diminished energy efficiency; (2) the radiated high frequency energy may interfere with radio receiving equipment located even at great distances from the heating equipment, mainly due to the content of harmonics in the radiated energy; (3) the radiated energy may represent a health hazard to personnel working at or near the machine if certain levels of radiated energy expressed in milliwatts per square centimeter exceed certain threshold levels established by the National Institute for Occupational Safety and Health Administration Notice CPL-2-2 o-Non-ionizing Radiation Citations, dated Sept. 4, 1979; (4) the wasted radiated high frequency energy may unnecessarily heat sections of the machine components which may be touched by the machine operator and cause burns or discomfort; and (5) the wasted energy may cause arcing between various machine elements and cause reduced life, e.g. piston rings may arc against cylinder walls and create burns.

SUMMARY OF THE PRESENT INVENTION

With the foregoing in mind, it is a principal object of the present invention to provide improved means of minimizing the amount of unwanted radiated radio frequency energy from dielectric heating machinery.

It is a second object of this invention to reduce the need for constantly fine tuning of the electrical constants of the resonating circuitry which is part of the radio frequency generator, due to changes in physical dimensions of the dielectric material to be heated and the changing of tools which form part of the total resonant circuitry.

It is a further object of the present invention to provide means for absorption and suppression of unwanted radiated high frequency energy in such a way that access to the machine tools is not hampered or restricted and so that material can flow through the machine without obstructions from the radiation suppressing apparatus.

It is a further important object of the present invention to provide means for absorption and suppression of radiated radio frequency energy, means that are superior in radiation suppression than prior known methods.

In both national and international circles, there is a rapidly increasing awareness of the need for containing unwanted emissions of radio frequency energy. The Federal Communications Commission is presently promulgating new, strict rules, e.g. FCC Docket 20-780, for spurious radio frequency emissions. It can be expected that older inefficient methods will not be allowed to continue operation without extensive screening and testing. With the present invention it has been demonstrated by careful measurements that the radiated level of radio frequency energy can be maintained at a level below three milliwatts per square centimeter, at an operating power of 25 kilowatts, measured at distances of 15 centimeters from the general circumference of the equipment.

To summarize, the improvements attained in the operation of a radio frequency heating press that has had the elements of the present invention attached to it, are:

(1) The level of the ambient radiation will be substantially reduced;

(2) The quality of the work is improved since the intensity of radiation applied to the work piece material is more uniform;

(3) Less machine maintenance is required due to less wasted radio frequency energy and hence reduced stress on the radio frequency energy;

(4) Less operator fatigue results from reduced exposure to radio frequency energy;

(5) Reduced need for fine tuning of the radio frequency generator results from reduced capacitive feedback on the radio frequency generator's resonating circuits from changes in the machine's ambient space;

(6) There is improved machine energy efficiency due to reduced wasted radio frequency energy being radiated into space;

(7) The dies, consisting of various tools, operate at lower temperatures;

(8) The material of the work piece external to the area being heat treated remains cooler due to reduced stray radiation;

(9) No arcing between various machine elements, such as piston rings and cylinder walls, reducing machine maintenance;

(10) There is less unnecessary heating of various machine elements outside the immediate tool area, which may cause operator discomfort or burns.

Other objects and advantages of the present invention will be readily apparent to those skilled in the art upon reading the following descriptions and upon reference to the drawings, in which:

DESCRIPTION OF THE PREFERRED EMBODIMENT

In order to better describe the present invention which related the radio frequency heating presses, and more specifically to means for reducing, or virtually eliminating, the amount of radio frequency (RF) energy that is normally radiated into space as wasted and harmful energy by conventional RF heating presses, it will be useful to first describe the construction and operation of a conventional typical RF heating press.

Figure 1:
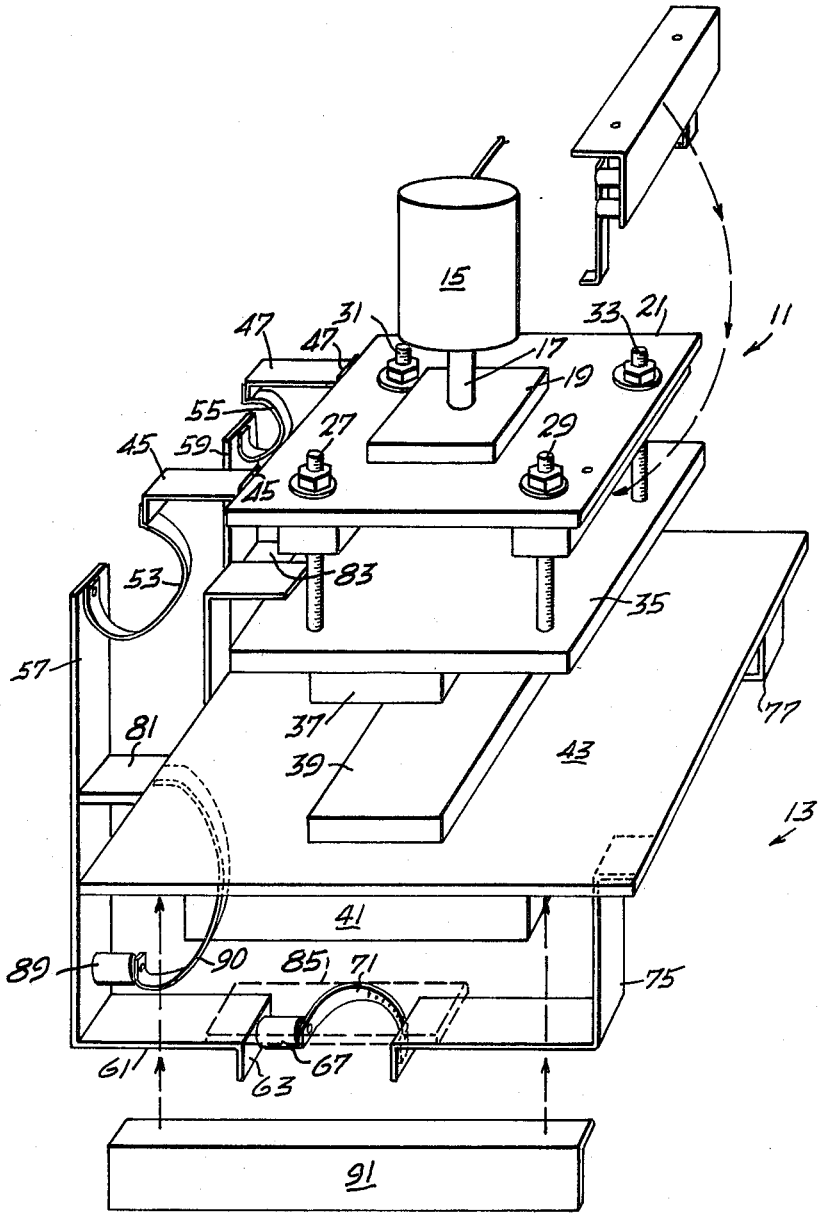
FIG. 1 shows a perspective, part left sideview and part front view of the main sections of a typical radio frequency heating press, with element of the present invention attached.

FIG. 1 is a perspective part left side view and part front view of the main elements of a conventional RF heating press. Of principal concern at this point are the parts of the machines which are involved in the treatment of the thermal plastic material and which are directly part of the RF conducting circuits. A number of machine elements such as the general supporting heavy metal frame, the RF power generator, the control circuits and timers that control the on-off cycling of the generator will be referred to only in passing.

Figure 2:
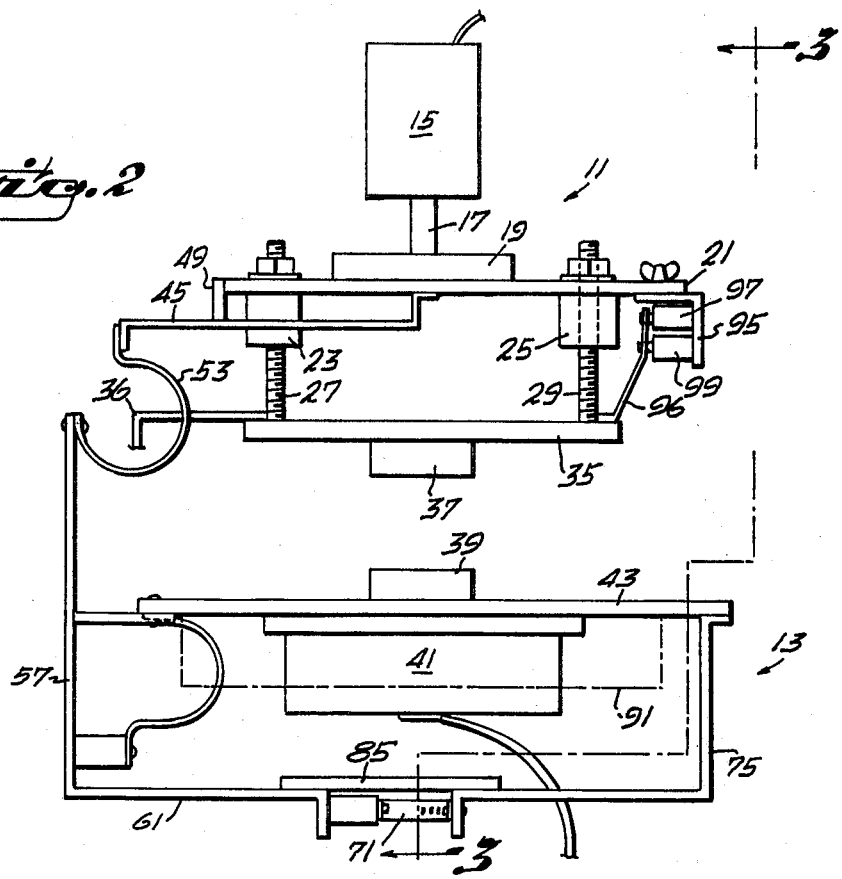
FIG. 2 is a left side elevational view of the same main sections of a radio frequency heating press with the elements of the present invention attached.
Figure 3:
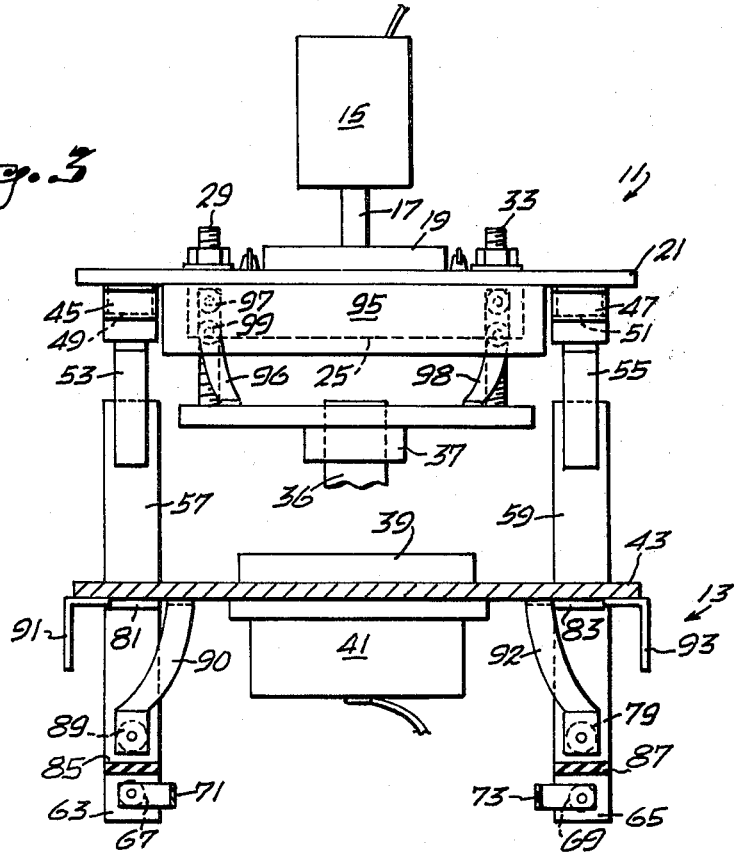
FIG. 3 is a part elevational, part sectional view from the front of the radio frequency heating press, cross-sectioned along the line 3—3 of FIG. 2.

FIG. 1 shows the upper movable section 11 and the lower stationary section 13 of the RF press. A pneumatic or hydraulic vertical cylinder 15, containing a piston (not shown) with a vertical shaft 17 connects to a sturdy horizontal metal anchor plate 19. Attached to the underside of the anchor plate 19 is a larger horizontal, generally rectangular connecting plate 21, extending horizontally beyond the perimeter of the anchor plate 19. The connecting plate 21 is made from a metal of high conductivity such as aluminum or copper. Attached to the underside of the connecting plate 21 are two sturdy, longitudinal, transversely oriented insulators 23 and 25 (better seen in FIG. 2). These insulators which have a generally rectangular cross section, are made from an insulating material with low dielectric loss factor and high dielectric strength such as phenolic or another similar, suitable material.

Attached to the insulators 23 and 25 are four (4) vertical leveling bolts 27, 29, 31 and 33. These bolts are attached to the insulators in such a way that they have no electrical contact with the connecting plate 21 and have adequate separation from the connecting plate to prevent arcing between the bolts and the connecting plate.

The leveling bolts 27, 29, 31 and 33 support from their extreme lower end a sturdy rectangular, generally horizontal leveling plate 35 made of a highly conductive metal such as copper or aluminum alloy. The leveling plate 35 serves as mechanical support for an upper tool 37, attached to the underside of the leveling plate 35. The tool 37, is the upper movable part of the die. The die consists of the upper tool 37 and the lower tool 39. The two tools 37 and 39 may be shaped in any suitable way as required to perform any of the many functions required by an RF heating press. As examples, the tools may serve to weld together various sheets of thermo plastic material, to emboss decorative patterns and textures, to seal and cut edges, etc.

The upper movable press section described by its individual parts above, is shown in its uppermost position in all figures. In this position, the two tools 37 and 39 are removed as far apart as possible leaving a space between the tools that will allow the machine operator to place the work material in the proper position between the two tools for processing.

An electrical conductor 36, typically in the form of a flat metal sheet of highly conductive material such as copper or aluminum is attached to the rear edge of the leveling plate 35. This conductor 36, which connects to the output source of the radio frequency generator through a flexible metallic strap (not shown) feeds radio frequency power to the leveling plate, hence to the upper tool 37 during the power-on phase of the work cycle, which takes place when the upper movable press section 11 is in its extreme lower position. During that time, the work material is held firmly in place between the upper and lower tools 37 and 39.

The lower stationary section of the RF press 13 is comprised of the bedplate 41. The bedplate is a sturdy generally planar horizontal metal part which is firmly secured to the main frame of the press, and of which the upper part 43 is a generally horizontal metal plate made of a highly conductive metal such as copper or aluminum. It extends beyond the perimeter of the bedplate 41 and serves as a general work table supporting the work material and to which the lower tool 39 is secured. The size, shape and general orientation of the two tools 37 and 39 are shown as typical references only. The construction elements of the present invention are shown on the figures referenced above, but before proceeding with a detailed description of said elements, it will be helpful to present a general description of the operation of the RF heating press described above. The description of the tools, and the press, should be considered typical and for reference only. Although various manufacturers of such presses generally choose different detail designs for their presses, it should be noted that, in general, all presses are manufactured with enough similarity in design that the above description can be understood by any person skilled in the art of mechanical and electrical designs.

A complete work cycle of a RF heating press consists of basically five (5) distinct phases. More phases may be added for more complex work processes, but the five phases described below are typically representative of a general, simple work cycle. The five phases are: (a) Loading Phase—during the loading phase the machine operator places the work material in the space between the two tools 37 and 39; (b) Press Phase—the press phase is initiated by the machine operator by depressing start buttons. By depressing the start buttons, electrical control circuitry is activated which causes compressed air or hydraulic fluid to be connected to the cylinder 15, causing the movable upper section of the press 11 to start its vertical downward travel until the tool 37 is pressing downward against the work material and the lower tool with a pressure which is typically 80–100 pounds per square inch. The duration of the press phase is controlled by a timer which is part of the electrical control equipment. At the lapse of the press phase timing, the next phase is initiated; (c) Heating Phase—the start of the heating phase is initiated by the application of RF energy to the upper tool. The lower tool is connected to ground which, in turn, is also connected to the RF ground return terminal of the RF generator. During the heating phase, the pressure is maintained on the work material.

The two tools 37 and 39, separated by the dielectric work material, from the equivalent of a lumped constant capacitor. The application of RF power to this capacitor causes a strong capacitive radio frequency current to flow through the work material, which causes the material to be heated due to the dielectric loss factor exhibited by the particular material. Depending upon the amount of power applied to the material, and during the time it is applied, the material softens or possibly partially melts, as demanded for the performance of the particular work process.

The duration of the heating process is controlled by a second timer which is also a part of the electrical control equipment for the press. At the lapse of the timing for the heating phase, the next phase starts, namely: (d) Cooling Phase—during the cooling phase, which is controlled by a third timer, the RF power is disconnected but the pressure on the work material is maintained. During the cooling phase, the high temperature reached by the tools and the work material during the heating phase gradually abates until the temperatures are reduced to the point where the pressure on the work material can be removed and where the tools and the material can be touched by the machine operator without discomfort. At the lapse of the cooling phase, the flow of the pneumatic or hydraulic fluid to the cylinder 15 is reversed, and the upper movable section 11 of the press starts its upward travel to its uppermost position. At that time, the work material can be removed and a new work cycle can be initiated.

During the heating phase (c) described above, the powerful generator of electrical radio frequency energy, typically in power range from a fraction of a kilowatt to 25 kilowatts and more and in the frequency range from 25 to 100 megahertz is connected, through suitable electrical conductors, to the work piece being clamped under pressure between two tools 37 and 39. During this condition the work piece and the two tools form a spatially large lumped constant capacitor, where the two main electrodes are the two tools and the dielectric is the work piece. During the heating phase a radio frequency voltage will exist between the electrodes of this lumped constant capacitor while a radio frequency current is flowing through the capacitor.

It is well established under these circumstances, where RF currents and voltages are present in conductors that are of a physical magnitude approaching the size of a quarter wavelength of the frequency applied thereto, these conductors will radiate unwanted RF energy, which is wasted, since it does not benefit the work process, and is harmful in a number of ways.

In this invention, the foregoing conventional equipment is modified with the following apparatus. Rigidly attached to the underside of the connecting plate 21 are disposed two conductors, typically in the form of two longitudinal metallic plates 45 and 47. These plates are conductively connected to the underside of said connecting plate at two points located on a line transversely oriented midway between the front and rear edges of the connecting plate 21 and in close proximity to the left hand and right hand edges thereof. These longitudinal metallic plates 45 and 47 are disposed in a horizontal plane disposed a distance from the underside of the connecting plate 21. The two longitudinal metallic plates 45 and 47 extend beyond the rear edge of the connecting plate 21 in a direction perpendicular to the rear edge to a horizontal line transversely oriented at a distance from the rear edge, typically a few inches therefrom. For practical mechanical reasons the two longitudinal metallic plates 45 and 47 are supported by two insulators 49 and 51 attached to the rear edge of the connecting plate 21. One of these insulators, 49, may be readily seen in the side view, FIG. 2.

The longitudinal metallic plates 45 and 47 are, like all the other conducting elements of the present invention, made from a metal of high conductivity such as aluminum or copper, or phosphor bronze when both flexibility and high conductivity are required. All insulators are made from an insulating material having high dielectric strength, low dielectric loss and good mechanical strength, such as phenolic or a similar insulating material.

Flexible straplike connecting conductors 53 and 55 made of phosphor bronze, or a similar flexible, highly conductive metal connects the rearmost ends of the plates 45 and 47 with the upper ends of two elongated generally vertical conducting members 57 and 59. These vertical conducting members 57 and 59 are rigidly attached to the long stationary section of the RF heating press. Therefore, the flexible straps 53 and 55 must possess sufficient flexibility and length to allow the upper movable section of the press 11 to travel unhindered between its extreme upper and lower positions. Said flexible straps form loops that are oriented inward toward the body of the RF press in order to minimize RF radiation.

The conducting members 57 and 59 have their uppermost edges connected to the lower edges of the flexible straps 53 and 55, and are disposed a short distance beyond the rear of the upper plate 43 of the bedplate 41. They extend vertically to a horizontal plane at 61 disposed below the lower surface of the bedplate 41 at which point these members 57 and 59 are bent to a 90 degree angle inwardly. Thereafter they extend horizontally in plane 61 beneath the bedplate 41 a short distance, typically a third of the distance between the front and the rear edges of the bedplate 41. At that point, the members are again bent to an angle of 90 degrees, extending vertically downward approximately a distance equal to the width of the members, thus forming a generally vertical square surface, at 63 and 65. On each of these square surfaces 63 and 65, a cylindrical axial capacitor 67 and 69 have been mounted in horizontal position with one terminal conductively attached to the square 63 and 65. The other terminal of each is connected to a first end of a pair of flexible conductive straps 71 and 73, said straps forming two loops (fractional turn inductors) extending horizontally inward toward the body of the RF heating press. A second end of each strap 71 and 73 is conductively attached to the end of a companion conducting member 75, and 77. Companion conducting members 75 and 77 are disposed in a horizontal plane below the lower surface of the bedplate 41, and are conductively connected to the underside of metal plate 43.

These two electrical circuits each containing a capacitor and a partial turn inductor form two series resonant electrical circuits tuned to be resonant at the radio frequency at which the RF heating press is working. This frequency is normally 27.12 megahertz, allocated by the FCC for this purpose, but the exact frequency is of no importance for the effectiveness of the present invention. The capacitors 67 and 69 have typically the value of 40 picofarads. The fractional turn inductors 71 and 73 are adjustable to the value required for resonating the circuit. The adjustment is made by lengthening or shortening the metal strap forming the loop. For this purpose, said strap is furnished with a string of adjusting holes. By selecting one of the holes used for securing the one end of the strap the proper inductive value is achieved. The two fractional turn inductors and the two capacitors form lumped constant parameters. In addition to the latter parameters, the circuit contains distributed capacitance and inductance which are also part of the total resonant circuits.

As is well known, a series resonant tuned circuit exhibits an impedance Z which is governed by the equation $Z=R+J\,(WL-1/WC)$, where R is a real number with the dimension of ohms, WL and $-1/WC$ are the imaginary parts of the total impedance, and J is the imaginary unit vector expressed by $\sqrt{1}$. By tuning the series resonant circuit, L and C are adjusted so that $WL=1/WC$, whereby Z becomes Z=R.

The figure R represents mainly all resistances and losses in the series resonant circuit. By properly selecting materials of high conductivity and low losses, Z may become a very low value, at the frequency used for the machine.

In this way, the two tuned series resonant circuits provide a very low impedance path between the connecting plate 21 and the plate 43 which effectively serve as a bypass for the radio frequency potential between said two plates which would otherwise be spent as wasted radiated energy.

For practical mechanical reasons, the various elements of the two tuned series resonant circuits must be mechanically supported by insulators. Insulators 49 and 51 provide support between the rear edge of the connecting plate 21 and the horizontal conductors 45 and 47. Insulators 81 and 83 provide support between the vertical conducting members 57 and 59 and the rear edge of upper part of the plate 43. The insulators 85 and 87 support the adjacent edges of the vertical conducting members 57 and 59 and the companion conducting members 75 and 77.

The present invention includes a number of additional elements which further serve to reduce radio frequency radiation from such machine 4. Positioned below the lower surface of the bedplate 41, attached to the two vertical conducting members 57 and 59 are two capacitors 89 and 79. These capacitors 89 and 79, which are typically of the size of approximately 40 pico farads are attached with one terminal conductively connected to the vertical sections of conducting members 57 and 59, and with the other terminals conductively connected via flexible metal straps 90 and 92 to points on the underside of the rear edge of the plate 43. These two capacitors 89 and 79 provide low impedance by-pass radio frequency connections from said vertical conducting members 57 and 59 to the grounded underside of the plate 43.

Positioned on the left and right hand edges of the plate 43, conductively and rigidly connected thereto are two metallic longitudinal side radiation reflectors 91 and 93. Said side reflectors, which are disposed in two vertical planes oriented from the front to the rear of the plate 43 provide additional radio frequency shielding against radiation leakage from the lumped constant resonant components 71, 67 and 73, 69 respectively.

A longitudinal, metallic front radiation reflector 95, conductively and rigidly connected to the front edge of the connecting plate 21, oriented in a vertical plane provides additional radio frequency shielding against radiation leakage oriented toward the front of the machine. Said front radiation reflector supports on its rear side, oriented toward the rear of the machine, positioned in the space between the connecting plate 21 and the leveling plate 35, a plurality of capacitors, and capacitors designated 97, 99 and the like mounted with one terminal in conductive contact with said front radiation reflector 95 and with the other terminals connected through flexible metallic straps 96, 98 and the like to points on the upper surface of the leveling plate 35, said connecting points being situated on a line generally adjacent to the front edge of said leveling plate 35. Said capacitors 97, 99, etc., have a capacitance value of typically 40 picofarads each.

It has been found by practical experimentation, that in order for the present invention to become totally effective, it is necessary to provide ground connections to certain locations of the machine. One ground connection is usually connected to the midpoint of the underside of the bedplate 41, the midpoint being defined as the point of intersection between two diagonal lines connecting the four corners of the lower surface of the bedplate 41. An alternate grounding method which, on certain types of machines, give better results in an arrangement consisting of two ground connections connected to the underside of the bedplate 41. In this case a ground connection is made to each of the points defined as follows: the midpoint of the left hand edge of the bottom surface of the bedplate 41, and the midpoint of the right hand edge of said bottom surface. In addition a ground connection connected generally to the center point of the top surface of the compressed air or hydraulic fluid cylinder 15, is usually provided by manufacturer of the press.

While the invention has been described in connection with a preferred embodiment, it will be understood that there is no intention thereby to limit the invention. On the contrary, there is intended to be covered all alternatives, modifications and equivalents as may be included within the spirit and scope of the appended claims, which are the sole definition of the invention.

What is claimed is:

1. In combination with radio frequency (RF) dielectric heating equipment of the type having a supporting frame, RF power source, control circuits and timers, movable and stationary tools, means to move at least one tool, RF power conductive connections among the tools and the RF power source, an improvement therein by addition thereto of apparatus for absorbing unwanted radiation comprising:

at least one movable RF conductor conductively connected to a movable tool of the RF dielectric heating equipment;

a first stationary RF conductor conductively connected to a first point on a stationary tool work table;

a second stationary RF conductor conductively connected to a second point on the stationary tool work table;

RF conducting means to permit RF conduction between the movable conductor and the stationary conductors;

a first capacitor conductively interposed between the movable conductor and stationary conductors; and a second capacitor and an inductor electrically interposed between the first stationary RF conductor and the second stationary RF conductor.

2. The apparatus of claim 1 wherein at least a part of the RF conducting means comprises a flexible conductor.

3. The apparatus of claim 2 wherein the flexible conductor is formed in a loop having its exterior oriented toward the RF dielectric heating equipment.

4. The apparatus of claim 2 wherein the flexible conductor is a phosphor bronze strap.

5. The apparatus of claim 1 wherein the stationary RF conductor is formed in a loop having its exterior oriented toward the RF dielectric heating equipment.

6. The apparatus of claim 1 wherein the inductor is a strap configured as a loop to form a fractional turn inductor.

7. The apparatus of claim 6 wherein the inductor is adjustable to form a resonating circuit with the second capacitor.

8. The apparatus of claim 1 which further comprises at least one side radiation reflector.

9. The apparatus of claim 1 which further comprises at least one front radiation reflector.

10. The apparatus of claim 9 which further comprises at least one capacitor electrically interposed between the front radiation reflector and the movable tool of the RF dielectric heating equipment.

11. In combination with radio frequency (RF) dielectric heating equipment of the type having a supporting frame, RF power source, control circuits and timers, movable and stationary tools, means to move at least one tool, RF power conductive connections among the tools and the RF power source and a radiation absorbing apparatus including an improvement of the radiation absorbing apparatus comprising:

at least one movable RF conductor conductively connected to a movable tool of the RF dielectric heating equipment;

a first stationary RF conductor conductively connected to a first point on a stationary tool work table;

a second stationary RF conductor conductively connected to a second point on the stationary tool work table;

RF conducting means to permit RF conduction between the movable conductor and the stationary conductors;

a first capacitor conductively interposed between the movable conductor and stationary conductors; and a second capacitor and a fractional turn inductor configured as a loop with its exterior toward the RF dielectric heating equipment, said second capacitor and fractional turn inductor electrically interposed between the first stationary RF conductor and the second stationary RF conductor.

12. In combination with radio frequency (RF) dielectric heating equipment of the type having a supporting frame, RF power source, control circuits and timers, movable and stationary tools, means to move at least one tool, RF power conductive connections among the tools and the RF power source and a radiation absorbing apparatus including an improvement of the radiation absorbing apparatus comprising:

at least one left movable RF conductor and one right movable RF conductor each conductively connected to a movable tool of the RF dielectric heating equipment;

a first left stationary RF conductor and a first right stationary RF conductor each conductively connected respectively to a first left point and a first right point on a stationary tool work table;

a second left stationary RF conductor and a second right stationary RF conductor each conductively connected respectively to a second left point and a second right point on the stationary tool work table;

RF conducting means to permit RF conduction between corresponding left movable RF conductor and left stationary RF conductors, and to permit RF conduction between corresponding right movable RF conductor and right stationary RF conductors;

a first left capacitor conductively interposed between the left movable RF conductor and left stationary RF conductors;

a first right capacitor conductively interposed between the right movable RF conductor and right stationary RF conductors;

a left second capacitor and a left fractional turn inductor configured as a loop with its exterior toward the RF dielectric heating equipment, said left second capacitor and left fractional turn inductor conductively interposed between the first left stationary RF conductor and the second left stationary RF conductor, and a right second capacitor and a right fractional turn inductor configured as a loop with its exterior toward the RF dielectric heating equipment, said right second capacitor and right fractional turn inductor conductively interposed between the first right stationary RF conductor and second right stationary RF conductor.

13. In combination with radio frequency (RF) dielectric heating equipment of the type having a supporting frame, RF power source, control circuits and timers, movable and stationary tools, means to move at least one tool, RF power conductive connections among the tools and the RF power source, an improvement therein by addition thereto of apparatus for absorbing unwanted radiation comprising:

at least one left movable RF conductor and one right movable RF conductor each conductively connected to a movable tool of the RF dielectric heating equipment;

a first left stationary RF conductor and a first right stationary RF conductor each conductively connected respectively to a first left point and a first right point on a stationary tool work table;

a second left stationary RF conductor and a second right stationary RF conductor each conductively connected respectively to a second left point and a second right point on the stationary tool work table;

RF conducting means to permit RF conduction between corresponding left movable RF conductor and left stationary RF conductors, and to permit RF conduction between corresponding right movable RF conductor and right stationary RF conductors;

a first left capacitor conductively interposed between the left movable RF conductor and left stationary RF conductors;

a first right capacitor conductively interposed between the right movable RF conductor and right stationary RF conductors;

a left second capacitor and a left inductor electrically interposed between the first left stationary RF conductor and the second left stationary RF conductor; and a right second capacitor and a right inductor electrically interposed between the first right stationary RF conductor and second right stationary RF conductor.

14. The apparatus of claim 13 wherein at least a part of the RF conducting means comprises a flexible conductor.

15. The apparatus of claim 14 wherein the flexible conductor is formed in a loop having its exterior oriented toward the RF dielectric heating equipment.

16. The apparatus of claim 14 wherein the flexible conductor is a phosphor bronze strap.

17. The apparatus of claim 13 wherein the stationary RF conductors are formed in a loop having its exterior oriented toward the RF dielectric heating equipment.

18. The apparatus of claim 13 wherein at least one inductor is a strap configured as a loop to form a fractional turn inductor.

19. The apparatus of claim 18 wherein each inductor is adjustable to form a resonating circuit with each corresponding second capacitor.

20. The apparatus of claim 13 which further comprises at least one side radiation reflector.

21. The apparatus of claim 13 which further comprises at least one front radiation reflector.

22. The apparatus of claim 21 which further comprises at least one capacitor electrically interposed between the front radiation reflector and the movable tool of the RF dielectric heating equipment.

* * * * *